FIGHIO OR 3,949,300

United States Patent [19]

Sadler

[11] 3,949,300

[45] Apr. 6, 1976

[54] EMERGENCY RADIO FREQUENCY WARNING DEVICE

[76] Inventor: William S. Sadler, 2000 Fernwood Ave., St. Paul, Minn. 55113

[22] Filed: July 3, 1974

[21] Appl. No.: 485,761

[52] U.S. Cl. ..... 325/31; 325/35; 325/132; 340/33

[51] Int. Cl.[2] ..... H04K 3/00

[58] Field of Search ..... 325/35, 45, 47, 55, 64, 325/103, 111, 117, 131, 132, 145, 152; 340/171 R, 177 R, 207 R, 208, 224, 225, 32, 33, 34, 384 E; 331/78, 178

[56] References Cited

UNITED STATES PATENTS

| | | | |
|---|---|---|---|
| 2,448,055 | 8/1948 | Silver et al. | 325/35 |
| 2,885,543 | 5/1959 | Williams | 325/132 |
| 2,994,765 | 8/1961 | Adam | 325/131 |
| 3,517,388 | 6/1970 | Vermillion | 325/132 |
| 3,660,811 | 5/1972 | Vail et al. | 325/132 |

*Primary Examiner*—Robert L. Griffin
*Assistant Examiner*—Jin F. Ng
*Attorney, Agent, or Firm*—James D. Haynes

[57] ABSTRACT

An electronic whistle in the form of broad band radio frequency interference generator. A broad band generator generates a coherent or random noise signal which is modulated by an audio signal which corresponds to an audible warning signal such as a whistle or a siren. The modulated signal is then utilized to modulate a carrier signal and amplified and transmitted so that the radios in vehicles in the immediate area will receive an audible interference signal regardless of the particular channel to which the radio is tuned. The audible interference signal may be an intelligible reproduction of the input audio signal so that the driver of the vehicle can determine whether the warning signal is generated by a train whistle, a siren or a human voice.

10 Claims, 1 Drawing Figure

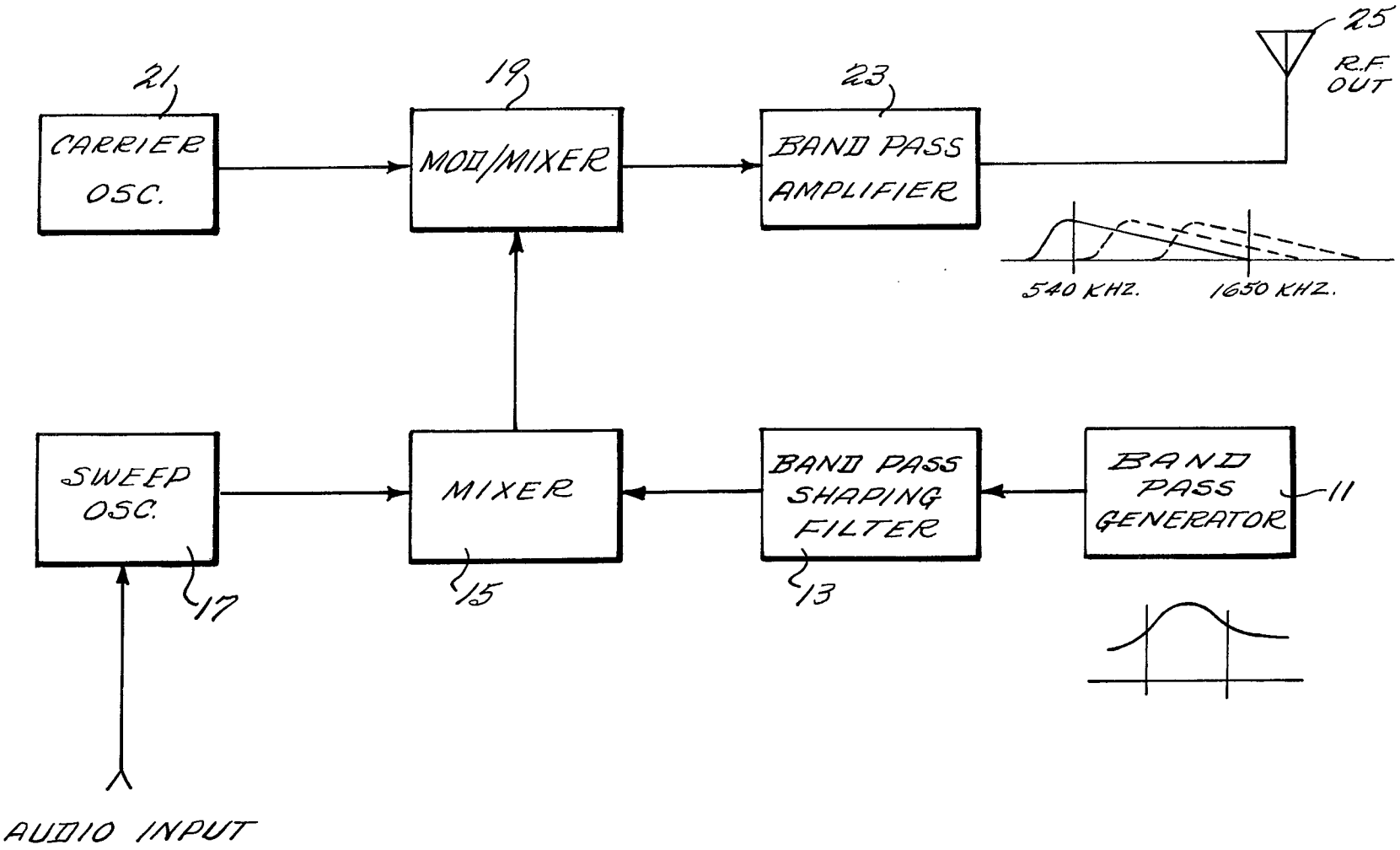
25
R.F. OUT
540 KHZ.
1650 KHZ.
23
BAND PASS AMPLIFIER
11
BAND PASS GENERATOR
19
MOD/MIXER
BAND PASS SHAPING FILTER
13
MIXER
15
21
CARRIER OSC.
SWEEP OSC.
17
AUDIO INPUT

EMERGENCY RADIO FREQUENCY WARNING DEVICE

BACKGROUND OF THE INVENTION

This invention relates to a radio frequency safety device and more specifically to an electronic whistle for warning radio listeners of potential danger.

The passenger compartments of automobile vehicles have become increasingly insulated from outside noise. Thus, drivers of such vehicles have become relatively isolated from normally audible danger signals such as sirens, whistles and horns which generate sound waves which are to a large extent attenuated before reaching the driver's ears. This trend towards an increased isolation of the driver has been enhanced because of the use of air conditioning which encourages the driver and passengers to keep the windows of the vehicle closed. When, for example, the windows of a vehicle are closed and the radio is playing, the aforementioned warning signals are often not heard, thereby placing the driver and the passengers in the vehicle in a potentially dangerous circumstance.

It therefore is an object of this invention to provide a means for warning passengers in a vehicle of the actuation of a siren or warning whistle in the surrounding area.

It is another object of the present invention to provide a radio frequency safety device for interfering with radio signals to generate a recognizable reproduction of a warning sound.

SHORT STATEMENT OF THE INVENTION

Accordingly, this invention relates to a radio frequency safety device which includes a means for generating a random noise signal having a broad frequency band. The random noise signal is appropriately filtered and shaped and is then modulated by means of a FM modulated signal having a frequency deviation which corresponds to that generated by a siren or whistle. The modulated noise signal is then utilized to modulate a radio frequency carrier signal. The carrier signal has a frequency which is outside of the commercial AM and FM broadcast bands but when modulated with the broad band noise signal, a modulated signal is provided which sweeps the entire broadcast band at an audio rate. Radio receivers in the vehicles located in the vicinity of the transmitter detect the modulated noise signal and the received signal accordingly interferes with the station or channel being received by the vehicle radio. Thus the broad band noise signal provides an interference signal which, since it is modulated by an audio frequency input, is audible to the passengers in the vehicle and is a recognizable reproduction of the originating sound, thereby warning the passengers of potential danger.

BRIEF DESCRIPTION OF THE DRAWING

Other objects, features and advantages of the invention will become more fully apparent from the following detailed description, appended claims and the accompanying drawing which is a schematic illustration of the radio frequency safety device of the present invention.

DETAILED DESCRIPTION OF THE PREFERRED EMBODIMENT

Refer now to the figure where there is disclosed in schematic block diagram form the radio frequency interference generator of the present invention. A broad band generator of conventional design 11 generates a noise signal having, for example, a Gaussian distribution.* The noise signal can be generated by any one of a number of techniques known in the art. The output of the broad band noise generator 11 is coupled to a bandpass shaping filter 13. The six db points of the filter 13 are typically 600 kHz apart and accordingly the output of the bandpass shaping filter 13 is a broad band noise signal having a bandwidth of 600 kHz and having a sloping or linearly decreasing amplitude over the bandwidth.

* The broad band component can be derived from either noise, impulse or square wave modulation.

This signal is coupled to the input of a heterodyne mixer 15 which is of conventional design. The frequency at the output of the mixer 15 is varied by the output of a sweep oscillator 17. The sweep oscillator 17 varies at an audio rate and preferably is controlled by an audio input which is either an electronic duplication of the sound of a train whistle or vehicle siren or is directly derived from such a whistle or siren or human voice by means of an appropriate transducer. The output of the sweep oscillator has a constant amplitude with the frequency of the output signal varying in accordance with the audio input signal. Hence, mixer 15 in net effect modulates the broad band noise signal so that the noise signal is swept across the AM or FM braodcast bands at an audio rate.

The output of mixer 15 is coupled to one input of a modulator 19. Modulator 19 may appropriately be of the AM or FM type, as desired, and preferably may include both an AM and a FM modulator so that the generated signal interferes with both the AM and FM commercial braodcast bands. The modulator 19 is of conventional design known in the art and accordingly is not disclosed herein in detail. The other input to the modulator 19 is derived from the output of a carrier oscillator 21 which generates a radio frequency carrier having a frequency which is below the lowest frequency of the commercial broadcast band to which the generated interference signal is directed. Thus, if the interference signal is to interfere with the commercial AM broadcast band which covers 540 kHz to 1650 kHz, the carrier oscillator preferably generates a carrier signal having a frequency of 540 kHz or lower. In the case of generating an interference signal for interfering with the FM broadcast band, the carrier oscillator 21 preferably generates a signal which is below 88 mHz. In the case where the modulator 19 provides both AM and FM modulation, the carrier oscillator 21 generates both a carrier having a frequency below 540 kHz and a FM carrier having a frequency below 88 mHz. Greater efficiency might be obtained in the FM band by generating discrete carriers on the frequency channels assigned for the particular community where the device is being used.

The output of the modulator 19 is coupled to an amplifier 23 of conventional design. The output of the amplifier 23 is transmitted via an antenna 25 to radios in the surrounding area. The power ranges and the antenna utilized are chosen so that the range of the interference signal transmitted is approximately 1000 feet so that the range of interference is approximately the same as conventional audio warning devices now in use. This is a sufficient distance to provide surrounding vehicles with a warning that a train or vehicle which is sounding the warning is approaching.

The interference provided by the signal output of the mixer 15 results in radio receivers generating a noise output which varies at an audio rate and hence can be detected by the driver or passenger in a vehicle receiving the signal. Further, since the random noise signal is modulated by the audio signal derived from a siren, horn or from a voice, this sound information is transmitted to the radio receivers. Thus, the driver hears a recognizable reproduction of the warning siren, horn or voice signal. This is invaluable in assisting the driver in understanding the nature of the warning, i.e., a fire truck siren, a train whistle, etc. It therefore can be seen that the present invention relates to an important method and apparatus for warning drivers of vehicles within a given area of impending danger.

While the present invention has been disclosed in connection with a preferred embodiment thereof, it should be understood that there may be other obvious modifications to the invention which fall within the spirit and scope of the invention as defined by the appended claims.

What is claimed is:

1. A radio frequency safety device comprising means for generating a noise signal having a broad frequency band, means for generating an RF signal, means responsive to an audio frequency signal for sweeping said RF signal generating means through a predetermined band at an audio rate, means for modulating said broad band noise signal with said RF signal, means for generating a carrier signal, and means for modulating said carrier signal with said modulated noise signal to thereby generate a broad band radio interference signal which generates an audible signal when received by a radio receiver, wherein said audible signal is a recognizable reproduction of said audio signal.

2. A radio frequency device comprising means for generating a signal having a broad frequency band, means for generating an RF signal, means responsive to an audio frequency signal for sweeping said RF signal generating means through a predetermined band at an audio rate, means for modulating said broad band signal with said RF signal, means for generating a carrier signal, and means for modulating said carrier signal with said modulated broad band signal to thereby generate a broad band radio interference signal which generates an audio signal when received by an audio receiver.

3. The radio frequency safety device of claim 2 wherein said audio signal corresponds to the signal generated by a siren.

4. The radio frequency safety device of claim 2 wherein said audio signal corresponds to a warning signal.

5. A radio frequency device comprising means for generating a signal having a broad frequency band, means for generating an RF signal, means responsive to an audio frequency signal for sweeping said RF signal generating means through a predetermined band at an audio rate, means for generating a carrier signal, means for amplitude modulating said carrier signal with said modulated broad band signal to thereby generate a broad band amplitude modulated radio interference signal for interfering with the commercial AM broadcast band, said interference signal generating an audible signal when detected by a radio receiver.

6. The radio frequency safety device of claim 5 wherein said carrier frequency is lower than 540 kHz and wherein said audio signal is a representation of an audible warning signal.

7. The radio frequency safety device of claim 6 further comprising a bandpass shaping filter for limiting the bandwidth of the output of said signal generator to substantially the AM and FM broadcast bands.

8. A radio frequency safety device comprising means for generating a signal having a broad frequency band, means for generating an RF signal, means responsive to an audio frequency signal for sweeping said RF signal generating means through a predetermined band at an audio rate, means for generating a carrier signal, means for frequency modulating said carrier signal with said modulated broad band signal to thereby generate a frequency modulated broad band radio interference signal for interference with the commercial FM broadcast band, said interference signal generating an audible signal when detected by a radio.

9. The radio frequency safety device of claim 8 wherein said carrier signal has a frequency lower than the lowest frequency in the FM broadcast band and wherein said audio signal is a representation of an audible warning signal.

10. The radio frequency device of claim 8 wherein said carrier signal has a frequency which coincides with discrete frequency assigned FM bands.

* * * * *